US005277047A

United States Patent [19]

Herdzina

[11] Patent Number: 5,277,047

[45] Date of Patent: Jan. 11, 1994

[54] CONVERSION SYSTEM TOOLING HEATER

[75] Inventor: Frank J. Herdzina, Schaumburg, Ill.

[73] Assignee: Service Tool International, Inc., Elk Grove Village, Ill.

[21] Appl. No.: 939,146

[22] Filed: Sep. 2, 1992

[51] Int. Cl.[5] ..... B21D 37/16; D06F 75/26

[52] U.S. Cl. ..... 72/342.92; 219/250; 413/55; 83/881

[58] Field of Search ..... 72/13, 21, 342.7, 342.92; 219/7.5, 10.57, 10.77, 250, 251; 413/15, 17, 66, 67, 55; 83/171, 879, 881

[56] References Cited

U.S. PATENT DOCUMENTS 3,584,487 6/1971 Carlson ..... 219/10.75
4,624,125 11/1986 Bulso, Jr. et al. ..... 413/67
4,891,529 1/1990 Braun et al. ..... 413/66
4,958,430 9/1990 Grieb et al. ..... 72/335
4,989,433 2/1991 Harmon et al. ..... 72/342.7

*Primary Examiner*—Lowell A. Larson
*Assistant Examiner*—Thomas C. Schoeffler
*Attorney, Agent, or Firm*—Kinzer, Plyer, Dorn, McEachran & Jambor

[57] ABSTRACT

The residual of an easy open can end is controlled by a band heater mounted on the anvil in conversion system tooling. The separation at closest approach of the score and anvil in the conversion tooling is altered as necessary by thermal expansion and contraction of the anvil as determined by the power supplied to the band heater. An electrical circuit supplies power to the heater and includes a thermocouple for maintaining the anvil at a set temperature. A loop control periodically diverts a finished end from the conveyor, measures the residual and adjusts power to the heater if necessary to bring the residual into specification.

8 Claims, 3 Drawing Sheets

CONVERSION SYSTEM TOOLING HEATER

BACKGROUND OF THE INVENTION

This invention relates to multiple-lane conversion systems. It is particularly adapted for conversion systems making easy open can ends.

Presses for converting ends for cans generally comprise a press bed having columns supporting a crown. The crown houses a drive for a reciprocating ram which slides on ways formed in the columns. The ram carries upper tooling which cooperates with lower tooling mounted on the bed. The tooling defines a plurality of lanes and stations in which shells are progressively converted into easy open can ends. A conveyor carries the shells into and through the stations of the tooling. A press of this character is shown and described in Herdzina, U.S. Pat. No. 5,017,072, the disclosure of which is incorporated herein by reference.

One of the stations is a score station wherein a score and anvil cooperate to partially cut through the end, thereby defining the frangible portion of the can that will open upon actuation of a tab. The thickness of the end at the scored line is called the residual. Obviously that thickness must be carefully controlled so that the end will properly protect the contents of a can until it is opened, at which time the scored portion must give way under the influence of the user's actuation of the tab.

The residual thickness depends on the separation of the score and anvil at their closest approach. In the past this distance was controlled by the use of mechanical shims placed in the support structure for one or both of the score and anvil. Obtaining the proper residual required installation of the correct thickness of shims and this was done by a process of trial and error. The press had to be stopped, the tools taken out, the shims put in, the tools reinstalled and the results tested. It was possible for adjustment of one lane to throw another one out of specification. Then that other one had to be adjusted, all with the consequent loss of production due to the downtime. Of course, redressing the scores required redoing the entire setup operation.

At a time when presses were running two lanes at about 225 strokes per minute the shim construction was acceptable. Now, however, presses having four to six lanes are running at 550 to 600 strokes per minute. At that rate of production it becomes very difficult to get the score stations in all lanes simultaneously set up and operating properly.

SUMMARY OF THE INVENTION

The present invention concerns conversion tooling for easy open can ends in which the score residual can be adjusted while the tooling continues to operate.

A primary object of the invention is a score station for conversion tooling that has an electric heater for adjusting the score and anvil separation at their closest approach.

Another object of the invention is a control-circuit for the score station's heater that maintains the score or anvil at a constant temperature.

A further object of the invention is a loop control that periodically tests the residual thickness and adjusts the control circuit if required to bring the residual back into specification.

These and other objects that may become apparent are realized by conversion system tooling for converting easy-open ends. The tooling includes at least one score station defined by a score and cooperating anvil which are mounted for reciprocating movement with respect to one another. An electrical heater is provided at the score station for setting the score residual by altering the separation of the score and anvil at their closest approach. The heater is in thermal communication with one of the score or anvil and is connected to an electrical control circuit means for controlling the amount of current supplied to the heater. This regulates the thermal expansion or contraction of the heated element, which in turn governs the separation of the score and anvil.

DETAILED DESCRIPTION OF THE INVENTION

Figure 1:
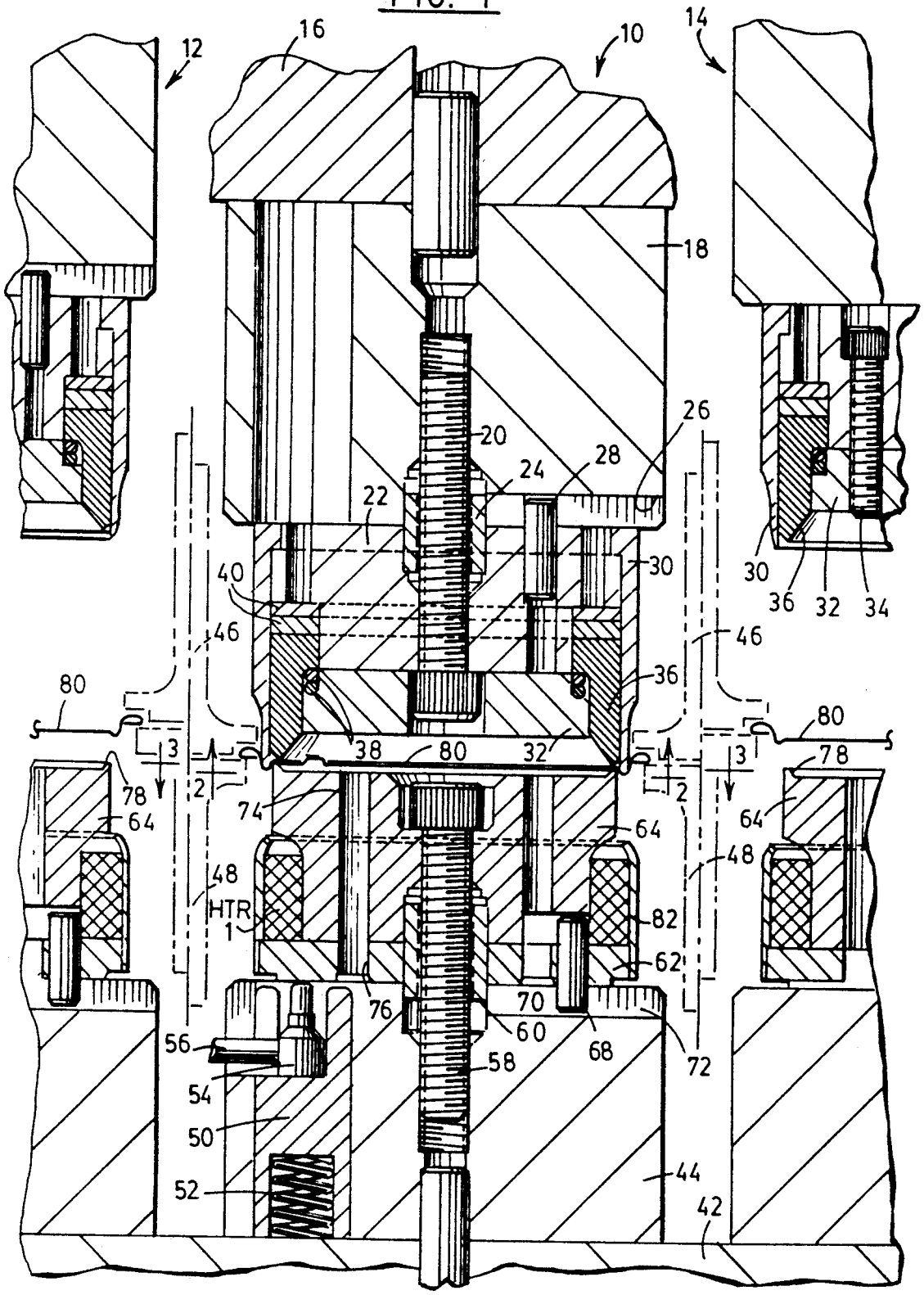
FIG. 1 is a vertical section through a score station, looking longitudinally of the conveyor. Portions of adjacent score stations are visible. It will be realized that the scores for all lanes are mounted on the same ram and accordingly they will never actually be out of phase as shown; they are illustrated as such for clarity.

FIG. 1 illustrates the tooling at a score station 10, looking longitudinally of one lane. Portions of similar score stations in adjacent lanes are visible at 12 and 14. The upper tooling of the station includes a punch holder 16 which is fixed to the ram of the press. The punch holder mounts an upper chase 18. Chase 18 has a central, threaded bore receiving a bolt 20 which secures a score base 22 to the chase. A locating bushing 24 spans the interface of the chase and score base. The bottom of the chase has a slot on one side 26 receiving a pin 28 which is set in a bore in the score base 22 to prevent rotation of the base.

Figure 2:
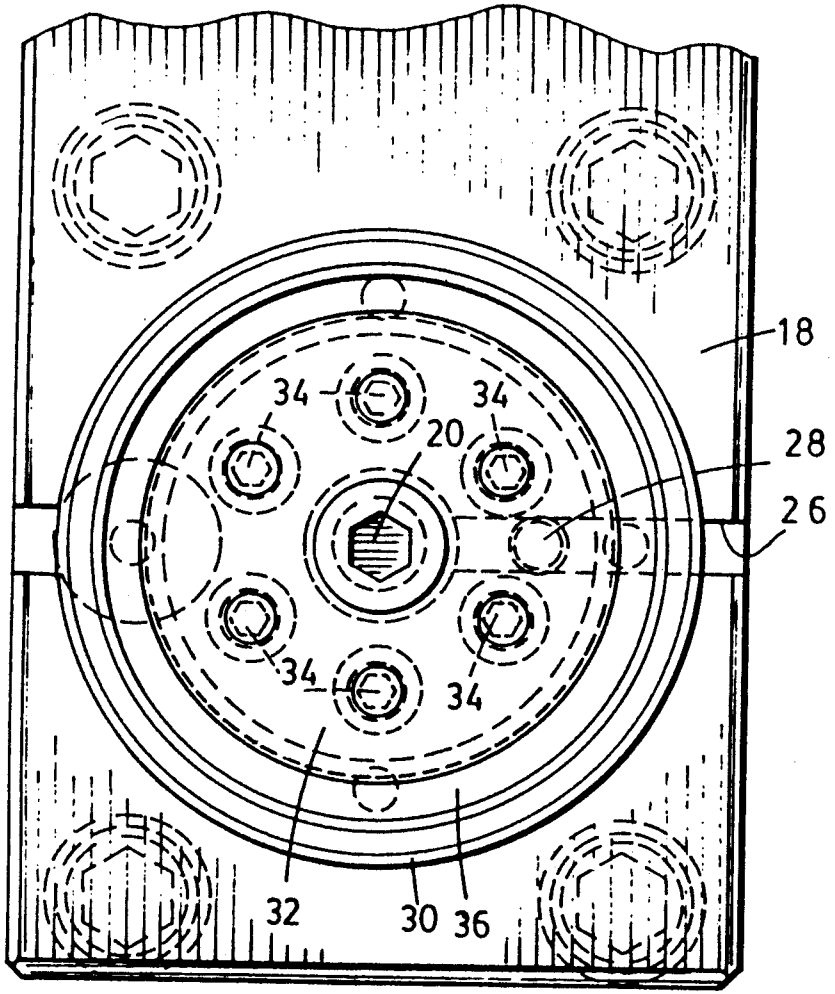
FIG. 2 is a bottom plan view of the score, looking in the direction of line 2—2 of FIG. 1.

The score base 22 clamps an upper flange of a score locating sleeve 30 to the bottom surface of the chase 18. A score clamp 32 is fixed to the base 22 by a plurality of bolts 34 (FIG. 2). The score itself is shown at 36, fixed between the clamp 32, sleeve 30 and base 22. O-rings 38 rest in a notch in the clamp 32, between the score and clamp. The upper surface of the score is bounded by one or more roughing shims 40.

Looking now at the lower tooling, a die shoe 42 mounted on the press's bolster supports a lower chase 44 within a vacuum box. The upper and lower rails of the vacuum box are shown in phantom lines at 46 and 48. The lower chase 44 has a bore which receives a ceramic insulator 50. A spring 52 located in a counterbore in the bottom of the insulator urges it upwardly. A second counterbore in the top of the insulator has a thermocouple 54 therein. Electrical lead 56 connects the thermocouple to the electric control circuit described below.

The lower chase 44 has a central, threaded bore receiving a bolt 58, and a counterbore receiving locating bushing 60. An insulating spacer 62 rests on top of the lower chase, located by the bushing 60.

Figure 3:
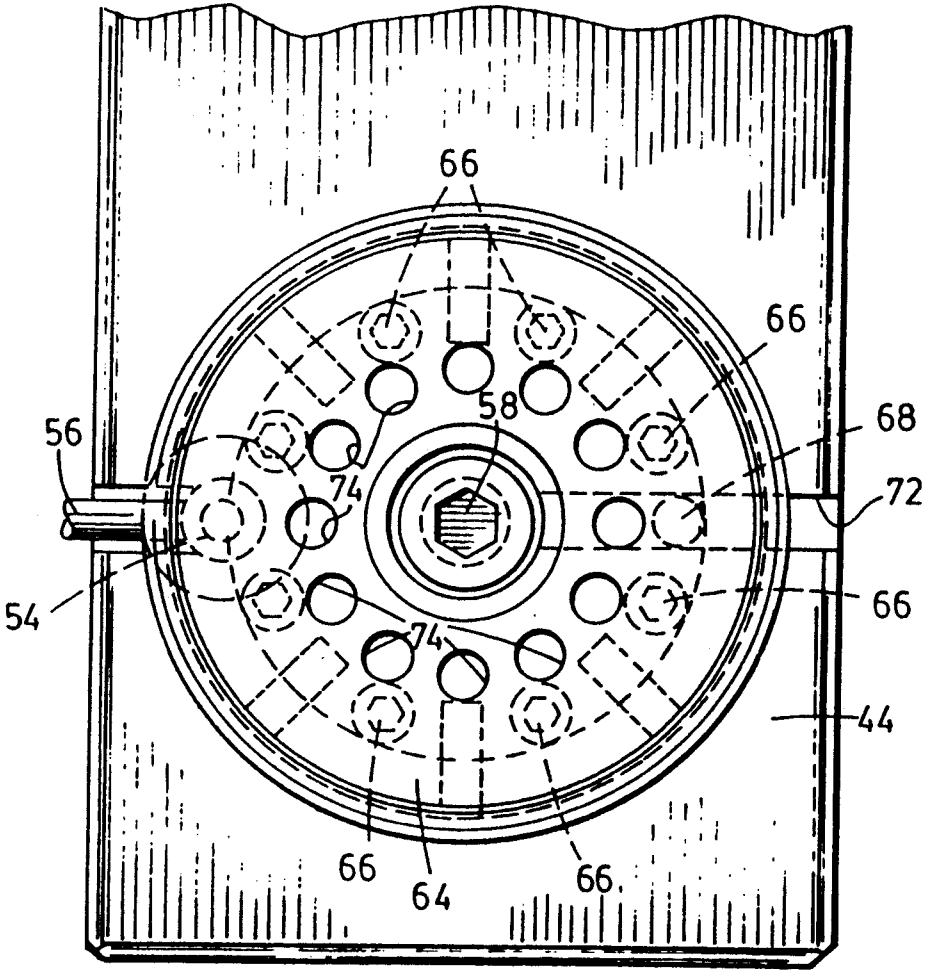
FIG. 3 is a plan view of the anvil, looking in the direction of line 3—3 of FIG. 1.

An anvil 64 sits on the insulating spacer 62, retained by the bolt 58 and a plurality of bolts 66 (FIG. 3). A pin 68 extends through the spacer 62 into slots 70 and 72 in the anvil and chase, respectively, to prevent rotation of the anvil. The anvil has a plurality of axial vent holes 74, aligned with similar holes 76 in the insulating spacer 62. The vents are placed In a circular pattern around the anvil, as seen in FIG. 3. The upper periphery of the anvil has a ridge 78 which cooperates with the sharp point of the score to create the score line in the end. The can end itself is shown at 80.

It will be noted that the lower half of the anvil defines a necked-down portion of reduced diameter. An electrical band heater 1HTR fits around the anvil at this portion. A heater cover 82 attached to the spacer 62 retains the heater in contact with the anvil. Electrical power connections are not shown but are, of course, provided to the band heater.

The design of the lower tooling maximizes the effectiveness of the band heater. The insulating spacer 62 minimizes heat loss to the lower chase. The vents 74 concentrate the heat in the outer portion of the anvil, again minimizing losses to the lower chase through the bolt 58. The indented configuration of the anvil and the placement of the heater cover 82 also assist in concentrating the heat from the band heater.

Figure 5:
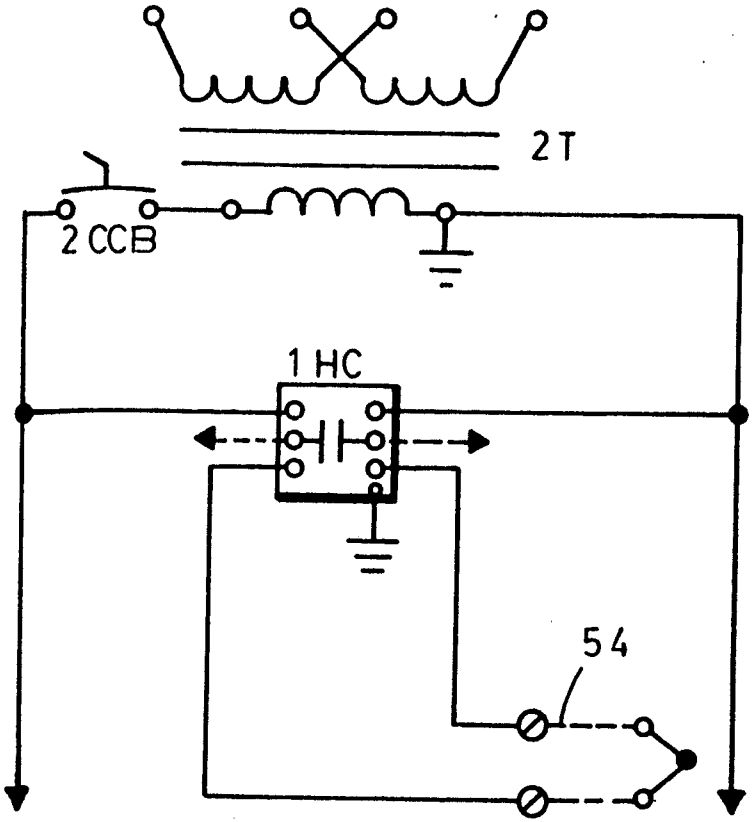
FIG. 5 is a circuit diagram of another portion of the heater control circuit.
Figure 4:
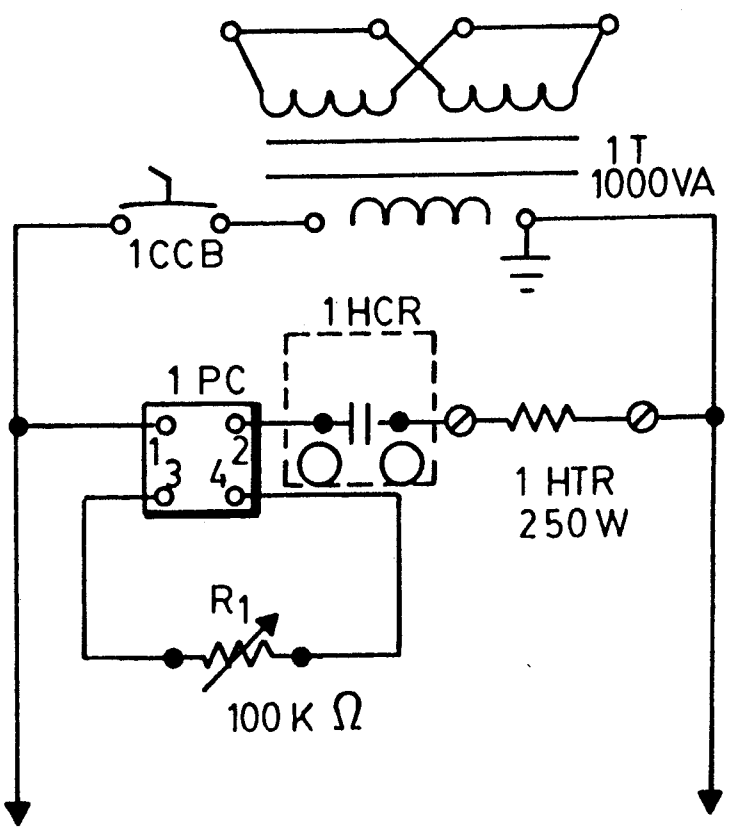
FIG. 4 is a circuit diagram of one portion of the heater control circuit.

The electrical control circuits for the band heater are shown in FIGS. 4 and 5. A transformer 1T supplies power to a proportional control 1PC through pushbutton switch 1CCB. The proportional control may be a Douglas Randall R10A or equivalent. A 100 k variable resistor R1 is connected to terminals 3 and 4 of the proportional control. The output of the control is connected to the contacts 1HCR of heater control 1HC (FIG. 5). The contacts 1HCR connect to the 250 watt band heater 1HTR.

In FIG. 5, transformer 2T supplies heater control 1HC through pushbutton switch 2CCB. The heater control may be a Chromalox 3910–11104 or equivalent. The thermocouple 54 is connected to the heater control 1HC as shown. It will be understood that each score station will have its own control circuit.

The use, operation and function of the invention are as follows. The press ram moves the upper tooling in a reciprocating motion as the conveyor advances ends into and out of the score station. The score 36 and anvil 64 cooperate to score the end. The separation of the score and anvil is controlled by the circuit of FIGS. 4 and 5. Thermocouple 54 is effective through its connection to the heater control 1HC to maintain a constant temperature at the thermocouple's contact point on the underside of the insulating spacer 62. When the residual is detected out of specification, an adjustment is made in the value of the variable resistor R1. This in turn alters the power supplied to the band heater 1HTR, either up or down as needed. The adjustment in heater power causes the anvil to either heat up or cool down, with a consequent expansion or contraction of anvil. This changes the separation of the anvil from the score and brings the residual back into specification.

An alternative embodiment could incorporate a closed loop control wherein the residual measurements are automatically made periodically with attendant adjustments of resistor R1. Such a system would incorporate a diverter mechanism for periodically taking an end off the conveyor and supplying it to a residual measuring device. The measuring device could be a model DA2 sold by EME Corp. of Arnold, Md. The output of the measuring device is sent to the circuit of FIG. 4 to control the value of R1. This provides continuing control of the residual without operator intervention.

I claim:

1. In conversion system tooling for converting easy-open ends, at least one score station including a score and cooperating anvil which are mounted for reciprocating movement with respect to one another, the improvement comprising adjustment means for setting the score residual by altering the separation of the score and anvil at their closest approach, the adjustment means comprising at least one electrical heater in thermal communication with a heated element which is one of the score or anvil, the heater being connected to electrical circuit means for controlling the amount of current supplied to the heater, and thereby regulating the thermal expansion or contraction of the heated element.

2. The structure of claim 1 further characterized in that the heated element is mounted on an isolator made of thermal insulating material.

3. The structure of claim 1 further characterized in that the heated element includes at least one vent formed therein.

4. The structure of claim 1 wherein the heated element is generally cylindrical and the heater is a band heater-wrapped at least partially around the circumference of said element.

5. The structure of claim 4 further characterized in that the heated element includes at least one vent in the form of an axial bore extending through the heated element.

6. The structure of claim 1 wherein the circuit means includes a thermocouple mounted so as to be responsive to the temperature of the heated element.

7. The structure of claim 6 wherein the circuit means further comprises a heater control responsive to the thermocouple to control the power supplied to the heater so as to maintain the heated element at a constant temperature.

8. The structure of claim 1 further comprising diverter means for extracting a sample of finished ends departing from the conversion tooling, means for measuring the residual of the diverted ends, and means for adjusting said circuit means in response to the measured residual to increase or decrease the power to the heater if nee to adjust the score-anvil separation and bring the residual into specification.

* * * * *